US006072456A

United States Patent [19]

Karube et al.

[11] Patent Number: 6,072,456

[45] Date of Patent: Jun. 6, 2000

[54] FLAT-PANEL DISPLAY DEVICE

[75] Inventors: Masao Karube; Yoshiro Aoki, both of Yokohama, Japan

[73] Assignee: Kabushiki Kaisha Toshiba, Kawasaki, Japan

[21] Appl. No.: 09/034,174

[22] Filed: Mar. 3, 1998

[30] Foreign Application Priority Data

Mar. 3, 1997 [JP] Japan ..... 9-047905

[51] Int. Cl.[7] ..... G09G 3/36

[52] U.S. Cl. ..... 345/98; 345/100; 345/55

[58] Field of Search ..... 345/98, 99, 100, 345/103, 204, 205, 211, 212, 213, 55

[56] References Cited

U.S. PATENT DOCUMENTS

| | | | |
|---|---|---|---|
| 4,824,212 | 4/1989 | Taniguchi | 345/103 |
| 5,682,175 | 10/1997 | Kitamura | 345/98 |
| 5,894,296 | 4/1999 | Maekawa | 345/98 |

FOREIGN PATENT DOCUMENTS 57-201295 12/1982 Japan .

*Primary Examiner*—Xiao Wu

*Attorney, Agent, or Firm*—Pillsbury Madison & Sutro LLP

[57] ABSTRACT

A flat-panel display device includes a display panel plate, a plurality of display pixels arrayed in a matrix on the display panel plate, a plurality of signal lines formed on the display panel plate along columns of the display pixels, a scanning line driving circuit formed on the display panel plate, for sequentially and periodically selecting rows of the display pixels to connect the display pixels of a selected row to the signal lines, and a signal line driver circuit formed on the display panel plate for driving the display pixels of a selected row via the signal lines. Particularly, the signal line driving circuit includes a plurality of signal line driver blocks which are arranged to partition the signal lines into signal line groups each constituted by a predetermined number of adjacent signal lines, receive individual video signals supplied for the signal line groups from an outside of the display panel plate, and perform operations of driving the signal line groups on the basis of the individual video signals, in parallel.

6 Claims, 9 Drawing Sheets

FLAT-PANEL DISPLAY DEVICE

BACKGROUND OF THE INVENTION

The present invention relate to a flat-panel display device wherein a plurality of display pixels are arranged in a matrix to display an image, and more particularly, to a flat-panel display device wherein a driving circuit is integrated on a substrate together with switching elements of the display pixels.

A liquid crystal display device is a flat-panel display device having characteristics of being thin and light-weight, and low power consumption, and is widely used in various fields such as television receivers and office automation devices because of the characteristics. For example, in an active-matrix type liquid crystal display device, a plurality of pixel electrodes, switching elements, scanning lines and signal lines are formed on a transparent glass plate. These pixel electrodes are arranged in a matrix, and a plurality of switching elements are respectively arranged to be adjacent to the pixel electrodes. A plurality of scanning lines are arranged along columns of the pixel electrodes, and a plurality of signal lines are arranged along the rows of the pixel electrodes. Each switching element becomes conductive upon driving of a corresponding scanning line to apply the potential of a corresponding signal line to a corresponding pixel electrode.

Recently, as a measure to produce such a liquid crystal display device at a low cost, it is considered to integrate a driver circuit such as a scanning driver for driving the scanning lines and a signal line driver for driving the signal lines, together with the switching elements, on the glass plate. Specifically, a plurality of thin film transistors are formed in a common manufacturing process as the switching elements, the scanning line driver, and the signal line driver. The signal line driver is constituted by, for example, a shift register and a plurality of analog switches. The shift register determines the sampling timings of a video signal supplied from the outside, and the analog switches sequentially sample the video signal under the control of the shift register to supply results of sampling to the respective signal lines.

Since the thin film transistor is formed by use of a non-monocrystalline semiconductor layer, it cannot easily obtain preferable operation characteristics therefrom and limits the sampling rate and the current driving ability of the signal line driver. This makes it difficult to sequentially sample the video signal with the adequate time margin. It is considered that such a problem can be solved by taking advantage of a video signal bus having a plurality of transmission lines. For example, when the video signal bus has two transmission lines through which odd-column and even-column video signals derived in advance from the video signal are transmitted in parallel to the signal line driver, the first transmission line is connected to odd-numbered signal lines via half of the analog switches, and the second transmission line is connected to even-numbered signal lines via the remaining half of the analog switches. The shift register is connected to sequentially drive groups of analog switches each assigned to corresponding two adjacent signal lines. The analog switches of each group simultaneously sample the odd-column video signal and the even-column video signal under the control of the shift register and supply them to the corresponding two adjacent signal lines, and therefore, the time margin of the sampling operation can be improved.

However, the wiring connecting the first transmission line with half of the analog switches intersects the wiring connecting the second transmission line and the remaining half of the analog switches at many portions, thereby creating a parasitic capacitance corresponding to the capacitive coupling between the wirings. Since this parasitic capacitance narrows the band width of the video signals to be transmitted, a problem that an excellent image cannot be displayed thereby arises. Further, the influence of the parasitic capacitance may become further serious when the number of pixels are increased to obtain a larger screen size or higher resolution in the liquid crystal display device.

BRIEF SUMMARY OF THE INVENTION

An object of the present invention is to provide a flat-panel display device which can moderate the parasitic capacitance of wirings to be increased upon an increase in the number of pixels.

This object can be achieved by a flat-panel display device which comprises a display panel plate; a plurality of display pixels arrayed in a matrix on the display panel plate; a plurality of signal lines formed on the display panel plate along columns of the display pixels; a scanning section formed on the display panel plate, for sequentially and periodically selecting rows of the display pixels to connect the display pixels of a selected row to the signal lines; and a driver section formed on the display panel plate, for driving the display pixels of the selected row via the signal lines, wherein the driver section includes a plurality of signal line driver blocks which are arranged to partition the signal lines into signal line groups each constituted by a predetermined number of adjacent signal lines, receive individual video signals supplied for the signal line groups from an outside of the display panel plate, and perform operations of driving the signal line groups on the basis of the individual video signals, in parallel.

In this flat-panel display device, individual video signals are provided for signal line groups each constituted by a predetermined number of adjacent signal lines, and supplied from the outside of the display panel plate to the signal line driver blocks which drive the signal line groups in parallel. That is, the wiring of each video signal does not need to be formed such that it extends from one signal line driver block to the other signal line driver blocks on the display panel plate. As a result, increase of the parasitic capacitance caused by increase of the display pixels can be remarkably suppressed. In addition, by increasing the number of video signals to be supplied to each signal line driver block, sufficient sampling margin can be obtained while reducing the parasitic capacitance of wirings.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

A liquid crystal display device according to a first embodiment of the present invention will now be described with reference to the drawings.

Figure 1:
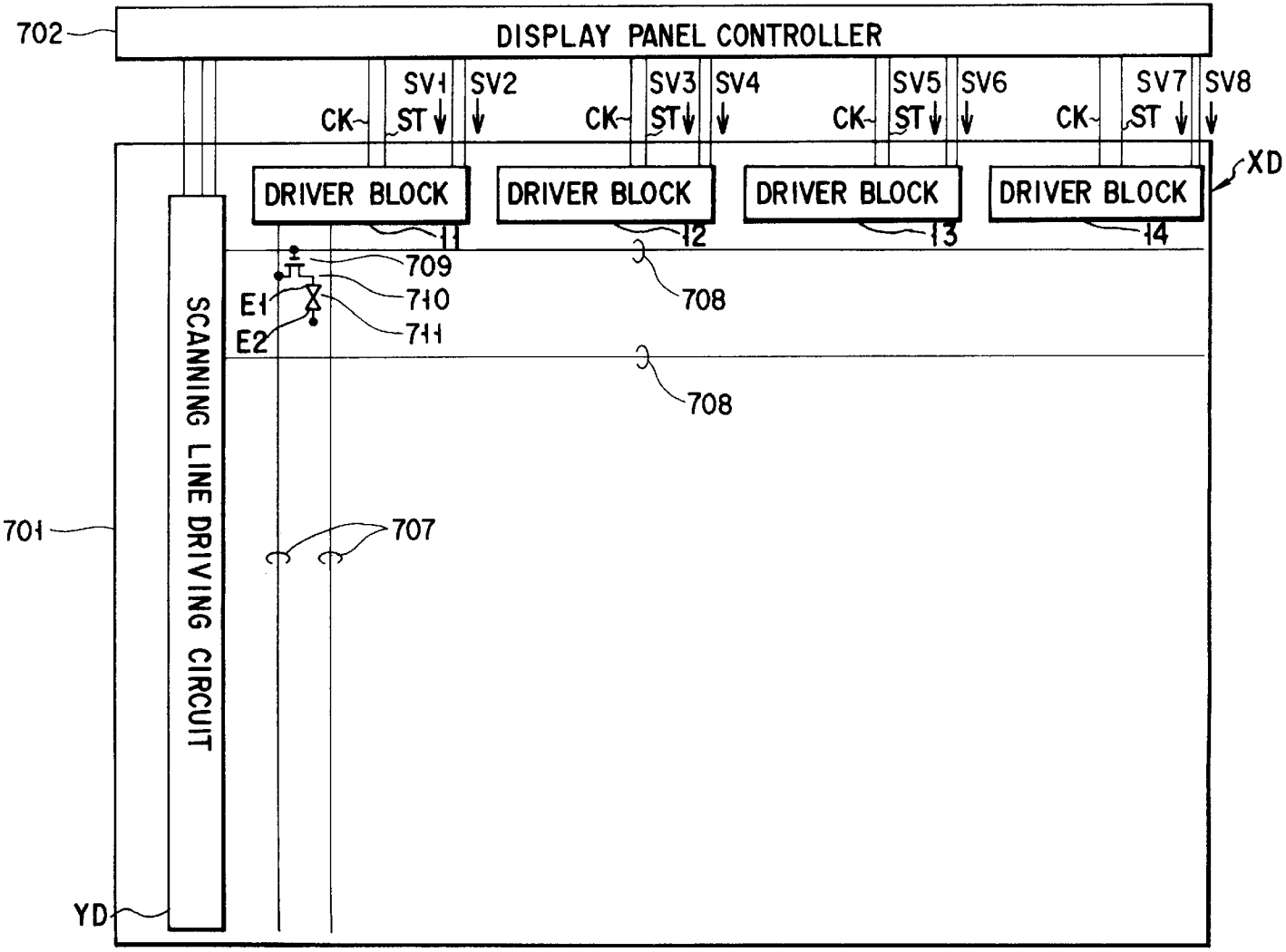
FIG. 1 is a circuit diagram schematically showing a liquid crystal display device according to a first embodiment of the present invention.

FIG. 1 schematically shows a circuit arrangement of the liquid crystal display device. This liquid crystal display device is, for example, an active matrix liquid crystal display panel for displaying color television images. The liquid crystal display device includes display panel plate 701 of a glass plate, a plurality of display pixels 710 arrayed in a matrix on the display panel plate 701, a plurality of signal lines 707 formed along columns of the display pixels 710 on the display panel plate 701, a plurality of scanning lines 708 formed along rows of the display pixels 707 on the display panel plate 701, and a plurality of switching elements 709 formed at intersections of the scanning lines 707 and the signal lines 708 and constituted by thin film transistors in a coplanar structure having a polycrystalline silicon film channel. Each switching element 709 is made conductive upon the drive of a corresponding scanning line 708 to apply the voltage of a corresponding signal line 708 to a corresponding display pixel 710. Each display pixel 710 is constituted by a pixel electrode E1 and a counter electrode E2 which are capacitively coupled via a liquid crystal layer 711. The liquid crystal display device further includes a scanning line driving circuit YD and a signal line driving circuit XD, which are formed outside the display pixels 710 on the display panel plate 701. The signal line driving circuit XD and the scanning line driving circuit YD are formed by using thin film transistors formed in the same process as those of the thin film transistors of the switch elements 709. The scanning line driving circuit YD is connected to the scanning lines 708 so as to sequentially drive the scanning lines 708 in every vertical scanning period. The signal line driving circuit XD is connected to the signal lines 707 to drive the signal lines 707 in every horizontal scanning period in which the display pixels of one row are selected by the drive of the scanning line formed along the display pixels. The scanning line driving circuit YD and the signal line driving circuit XD are controlled by a display panel controller 702 disposed outside the display panel plate 701.

To facilitate fabrication, the display panel plate 701 and the display panel controller 702 are connected to each other only at an edge located on the signal line driving circuit XD side. The display panel controller 702 is formed on a printed wiring board, and a flexible wiring film is used to connect the printed wiring board and the display panel plate 701.

The scanning line driving circuit YD is constituted by, for example, a shift register, and operated under the control of a control signal supplied from the display panel controller 702 together with the power source potential and the ground potential.

Figure 2:
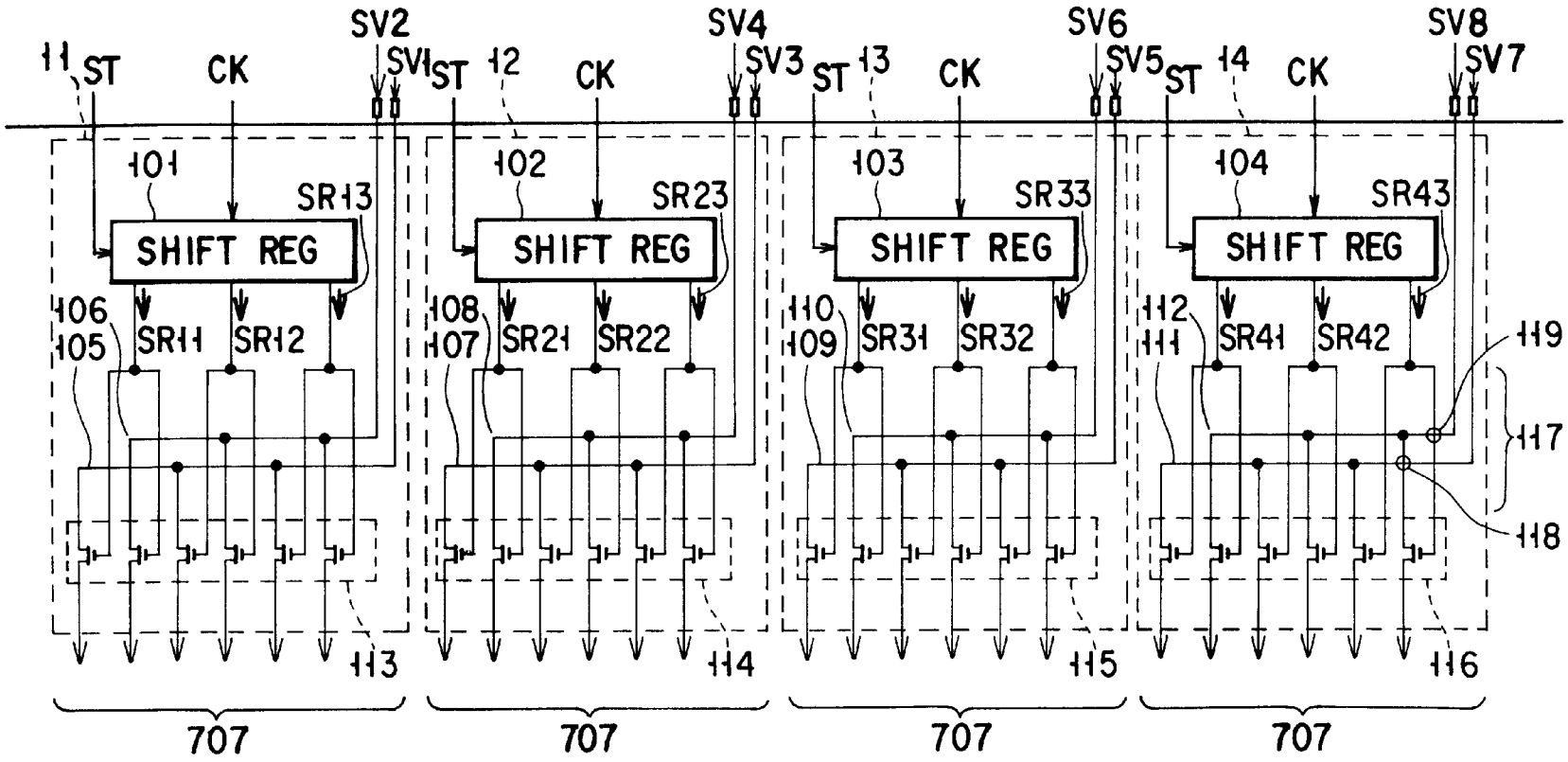
FIG. 2 is a circuit diagram showing in detail a signal line driving circuit shown in FIG. 1.

As shown in FIG. 2, the signal line driving circuit XD includes a plurality of signal line driver blocks 11, 12, 13, 14, . . . which are arranged to divide the signal lines 707 into signal line groups each having a predetermined number of adjacent signal lines 707, and which receive individual video signals SV1 to SV8 supplied from the display panel controller 707 for the signal line groups, and execute in parallel the operations of driving the signal line groups in accordance with the individual video signals SV1 to SV8. The odd-column video signal SV1 and the even-column video signal SV2 are supplied to the signal line driver block 11, the odd-column video signal SV3 and the even-column video signal SV4 are supplied to the signal line driver block 12. The odd-column video signal SV5 and the even-column video signal SV6 are supplied to the signal line driver block 13. The odd-number-column video signal SV7 and the even-column video signal SV8 are supplied to the signal line driver block 14. These video signals SV1 to SV8 are supplied together with control signals such as a clock CK and a horizontal start pulse ST. In FIG. 2, six adjacent signal lines 707 less than the actual ones are shown so as to avoid complication of each signal line group. The following explanations are made in accordance with this.

The signal line driver blocks 11, 12, 13 and 14 include first transmission lines 105, 107, 109 and 111 for transmitting the odd-column video signals SV1, SV3, SV5 and SV7, second transmission lines 106, 108, 110 and 112 for transmitting the even-column video signals SV2, SV4, SV6 and SVB, groups of analog switches 113, 114, 115 and 116 assigned to the six adjacent signal lines 707 and alternately assigned to the first transmission lines 105, 107, 109 and 111 and the second transmission lines 106, 108, 110 and 112, each for sampling the video signal on a corresponding transmission line to supply the sampled video signal to a corresponding signal line 707, and monoclock-type shift registers 101, 102, 103 and 104 each formed to divide the analog switches 113, 114, 115 and 116 to a plurality of analog switch groups constituted by two adjacent analog switches 113, 114, 115 and 116 whose number is equal to that of the transmission lines and serve as a timing control circuit for sequentially enabling the sample operations of the analog switch groups.

These components are formed to have the same structure in the signal line driver blocks. When each of the signal line groups is constituted by six adjacent signal lines in order to avoid complication, the number of the analog switch groups is three. The first and second transmission lines 105 and 106, 107 and 108, 109 and 110, and 111 and 112, constitute video signal buses independently connected to the display panel controller 702. These video signal buses are formed to have video signal input terminals at the boundary portions (one-end sides of the shift registers 101, 102, 103 and 104, in this embodiment) of the driver blocks on the display panel plate 701, and extend across the connection wirings between the shift registers 101, 102, 103 and 104, and the analog switches 113, 114, 115 and 116. The video signal buses belonging to the respective driver blocks are arranged so as to be electrically insulated from one another. Accordingly, each of the video signal buses does not intersect the wirings in the other driver blocks, thereby reducing the load capacitance and remarkably improving the band width characteristic. The first and second transmission lines of the signal line driver blocks have the same wiring length and parasitic capacitance, i.e. wiring load. The first transmission lines 105, 107, 109 and 111 are connected to the odd-numbered signal lines 707 via the odd-numbered analog switches 113, 114, 115 and 116, and the second transmission lines 106, 108, 110 and 112 are connected to the even-numbered signal lines 707 via the even-numbered analog switches 113, 114, 115 and 116. These transmission lines 105–112 are formed in the same process as that for the formation of source and drain electrodes of the thin film transistors serving as the switching elements 709. The shift registers 101, 102, 103 and 104 are formed of flip-flops whose number is equal to that of the analog switch groups arranged in series so as to shift a start pulse ST input to the first flip-flop in the forward direction toward the final flip-flop in response to the clock CK, and thereby sequentially generate enable signals from output terminals SR11, SR12, SR13; SR21, SR22, SR23; SR31, SR32, SR33; and SR41, SR42, SR43. Each flip-flop is a well-known CMOS clocked inverter circuit and formed by combining thin film transistors obtained in the same process as that for the formation of the thin film transistors serving as the switching elements 709. The shift registers 101–104 are in the monoclock-type, but may be constituted to respond to the clock CK and the reverse clock.

In addition, the shift registers 101–104 may be operated not by the electric power supplied directly from the outside, but by the electric power supplied via a power source line and a ground line (not shown) which are formed as a common bus extends across the signal line driver blocks 11–14.

Figure 3:
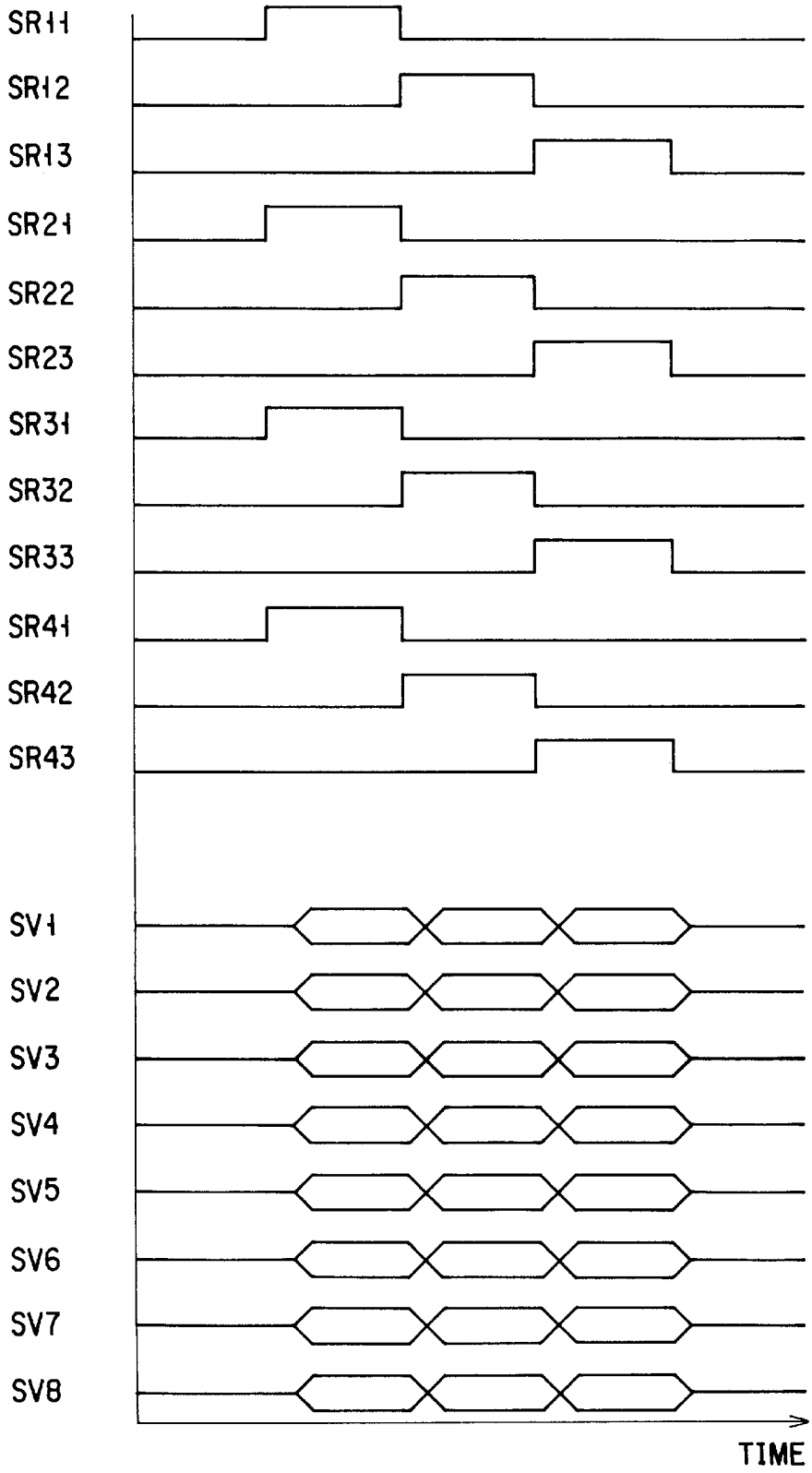
FIG. 3 is a time chart showing an operation of the signal line driving circuit shown in FIG. 2.

FIG. 3 shows an operation of the signal line driver circuit XD. As shown in FIG. 3, the shift registers 101, 102, 103 and 104 performs in parallel the operations of sequentially generating enable signals from output terminals SR11, SR12, SR13; SR21, SR22, SR23; SR31, SR32, SR33; and SR41, SR42, SR43 in response to the clock CK. That is, the enable signals are output in a first clock cycle from the output terminals SR11, SR21, SR31 and SR41, in a second clock cycle from the output terminals SR12, SR22, SR32 and SR42, and in a third cycle from the output terminals SR13, SR23, SR33 and SR43, and are output in the same manner if there are the following clock cycles. As a result, the odd-column video signals SV1, SV3, SV5 and SV7 and the even-column video signals SV2, SV4, SV6 and SV8 are sequentially sampled by the analog switch groups receiving the enable signals in the first to third clock cycles and are supplied to the corresponding signal lines 707.

In the above-described first embodiment, the width of the region 117 occupied by the video signal buses shown in FIG. 2 can be reduced. In addition, the number of overlapping portions 118 and 119 where the video signal buses intersect the wirings between the shift registers and the analog switches, can be reduced. As a result, the width of the signal line driver circuit XD can be reduced and the transmission band width of the video signal lines can be improved by reduction of the load capacitance.

In addition, the display panel controller 702 is disposed at one edge of the display panel plate 701 which is located on the signal line driver circuit XD side. This allows the wiring length on the display panel plate to be shorter as compared with a case where the video signals supplied to the video signal bus from the one edge of the display panel plate 701 which is located on the scanning line driver block YD side and the video signal bus is extended to match the span of the signal line driver circuit XD, thus improving the transmission band width of the video signal bus.

Further, since all the signal line driver blocks sequentially drive the adjacent signal lines 707 of the respective signal line groups in the same direction, the odd-column and even-column video signals do not need to be further rearranged in accordance with the driving order. Therefore, the circuit scale of the display panel controller can be made smaller.

Figure 4:
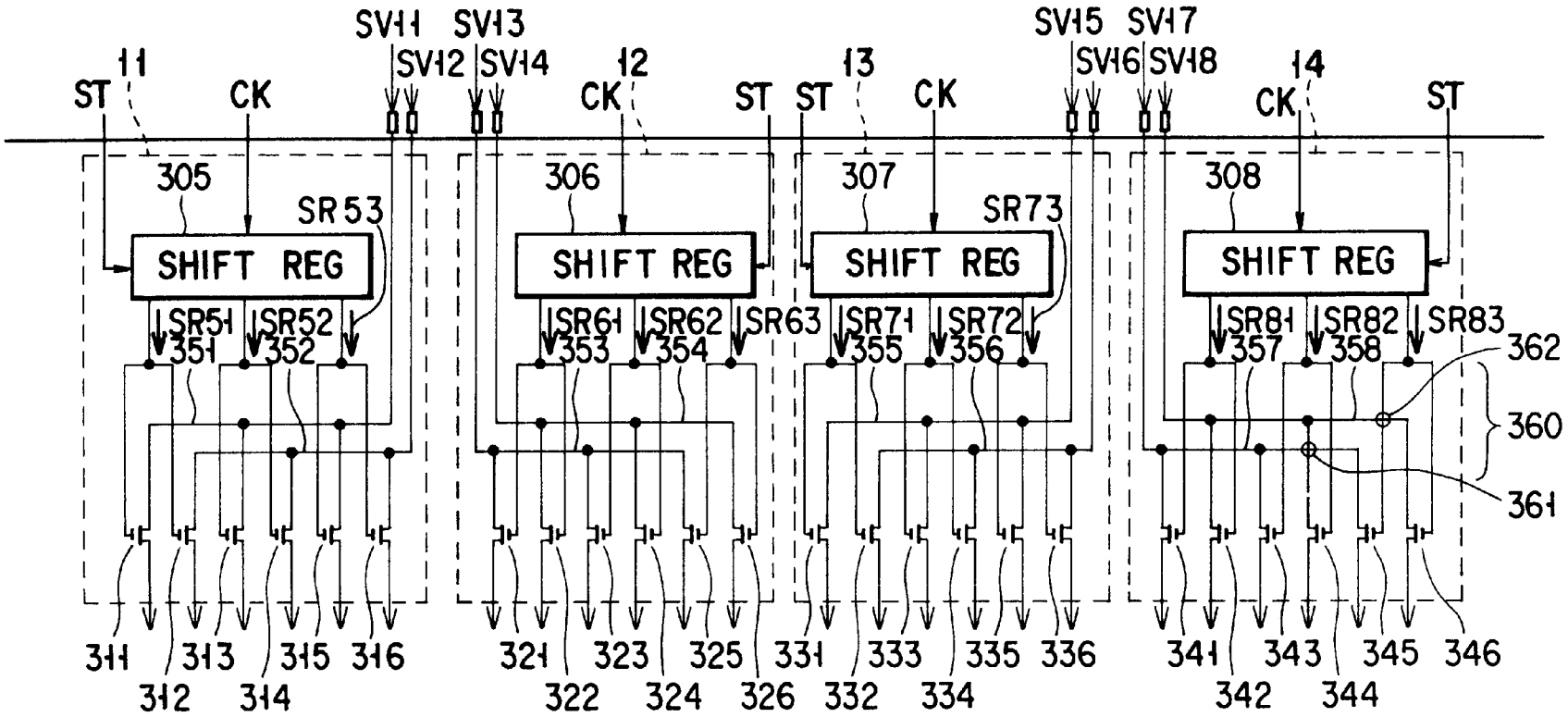
FIG. 4 is a circuit diagram showing in detail a signal line driving circuit of a liquid crystal display device according to a second embodiment of the present invention.

Next, a liquid crystal display device according to a second embodiment of the present invention will be described with reference to FIGS. 4 and 5. This liquid crystal display device is similar to the first embodiment, except for matters described below. FIG. 4 shows the configuration of the signal line driver circuit XD of the liquid crystal display device, and FIG. 5 shows an operation of of the signal line driver circuit XD.

The signal line driver blocks 11–14 are constituted as shown in FIG. 4. The signal line driver blocks 11, 12, 13 and 14 respectively include first transmission lines 351, 353, 355 and 357 for transmitting odd-column video signals SV11, SV13, SV15 and SV17, second transmission lines 352, 354, 356 and 358 for transmitting even-column video signals SV12, SV14, SV16 and SV18, groups of analog switches 311–316, 321–326, 331–336 and 341–346 assigned to the six adjacent signal lines 707 and alternately assigned to the first transmission lines 351, 353, 355 and 357 and the second transmission lines 352, 354, 356 and 358, each for sampling video signal on a corresponding transmission line to supply the sampled video signal to a corresponding signal line 707, and monoclock-type shift registers 305, 306, 307 and 308 each formed to divide the analog switches 311–316, 321–326, 331–336 and 341–346 into a plurality of analog switch groups constituted by two adjacent analog switches whose number is equal to that of the transmission lines and serve as a timing control circuit for sequentially enabling the sample operations of the analog switch groups. These components are formed to have the same structure in the signal line driver blocks, except for the arrangement of first and second signal lines 351–358 and the shifting direction of the shift registers 305, 306, 307 and 308. When each of the signal line groups is constituted by six adjacent signal lines in order to avoid complication, the number of the analog switch groups is three. The first and second transmission lines 351 and 352, 353 and 354, 355 and 356, and 357 and 358, respectively constitute video signal buses independently connected to the display panel controller 702. The video signal buses are formed to have the video signal input terminals at one-end portions or the other end portions of the shift registers 305, 306, 307 and 308 on the display panel plate 701, and to extend across the connection wirings between the shift registers 305, 306, 307 and 308, and the analog switches 311–316, 321–326, 331–336 and 341–346. That is, the video signal input terminals of the transmission lines 351 and 352 are arranged at the one-end side of the shift register 305, the video signal input terminals of the transmission lines 353 and 354 are arranged at the other end side of the shift register 306, the video signal input terminals of the transmission lines 355 and 356 are arranged at the one-end side of the shift register 307, and the video signal input terminals of the transmission lines 357 and 358 are arranged at the other end side of the shift register 308. The first and second transmission lines of the signal line driver blocks have the same wiring length and parasitic capacitance, i.e. the wiring load.

The first transmission lines 351, 353, 355 and 357 are connected to the odd-numbered signal lines 707 via the odd-numbered analog switches 311, 313, 315; 321, 323, 425; 331, 333, 335; and 341, 343, 345. The second transmission lines 352, 354, 356 and 358 are connected to the even-numbered signal lines 707 via the even-numbered analog switches 312, 314, 316; 322, 324, 426; 332, 334, 336; and 342, 344, 346. These transmission lines 351–358 are formed in the same process as that for formation of the source and drain electrodes of the thin film transistors serving as the switching elements 709. The shift registers 305, 306, 307 and 308 are formed of flip-flops whose number is equal to that of the analog switch groups arranged in series so as to shift a start pulse ST input to the first flip-flop in the forward direction toward the final flip-flop in response to a clock CK, and thereby sequentially generate enable signals from output terminals SR51, SR52, SR53; and SR71, SR72, SR73. The shift registers 306 and 308 shift the start pulse ST input to the final flip-flop in the reverse direction toward the first flip-flop in response to the clock CK, and thereby sequentially generate enable signals from output terminals SR63, SR62, SR61; and SR83, SR82, SR81. Each flip-flop is a well-known CMOS clocked inverter circuit and formed by combining thin film transistors obtained in the same process as that of the thin film transistors serving as the switching elements 709.

Figure 5:
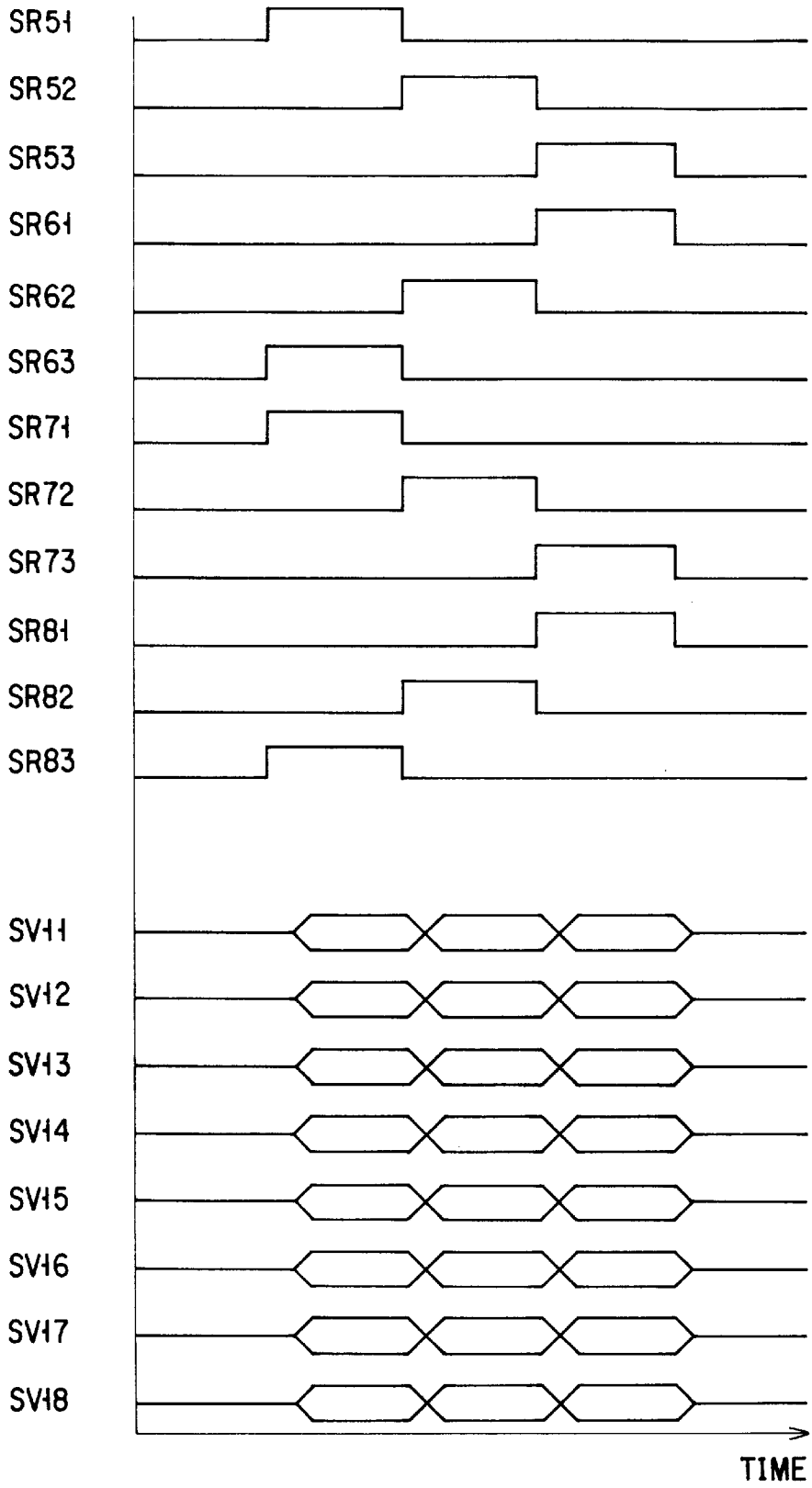
FIG. 5 is a time chart showing an operation of the signal line driving circuit shown in FIG. 4.

FIG. 5 shows an operation of the signal line driver circuit XD. As shown in FIG. 5, the shift registers 305, 306, 307 and 308 perform in parallel the operations of sequentially generating the enable signals from the output terminals SR51, SR52, SR53; SR62, SR61; SR71, SR72, SR73, and SR83, SR82, SR81 in response to the clock CK. That is, the enable signals are output in a first clock cycle from the output terminals SR51, SR63, SR71 and SR83, in a second cycle from the output terminals SR52, SR62, SR72 and SR82, in a third cycle from the output terminals SR53, SR61, SR73 and SR81, and are output in the same manner if there are the following clock cycles. As a result, the odd-column video signals SV11, SV13, SV15 and SV17 and the even-column video signals SV12, SV14, SV16 and SV18 are sequentially sampled by the analog switch groups receiving the enable signals in the first to third cycles and are supplied to the corresponding signal lines 707.

In the above-described second embodiment, the width of a region 360 occupied by the video signal buses shown in FIG. 4 can be reduced. In addition, the number of overlapping portions 361 and 363 where the video signal buses intersect the wirings between the shift registers and the analog switches, can be reduced. As a result, the width of the signal line driver circuit XD can be reduced and the transmission band width of the video signal lines can be improved by reduction of the load capacitance.

Further, the display panel controller 702 is arranged at one edge of the display panel plate 701 which is located on the signal line driver circuit XD side. This allows the wiring length on the display panel plate to be shorter as compared with a case where the video signals supplied to the video signal bus from the one edge of the display panel plate 701 which is located on the scanning line driver block YD side and the video signal bus is extended to match the span of the signal line driver circuit XD, thus improving the transmission band width of the video signal bus.

However, the signal line driver blocks 11 and 13 sequentially drive the adjacent signal lines 707 of the respective signal line groups in the forward direction, and the signal line driver blocks 12 and 14 sequentially drive the adjacent signal lines 707 of the respective signal line groups in the reverse direction. Therefore, the odd-column video signals and the even-column video signals need to be further rearranged according to the drive order. In this case, the circuitry scale of the display panel controller becomes large, but since analog switches having the same wiring load are simultaneously driven between the adjacent signal line driver blocks, irregularity of display shaped in a stripe can be suppressed as compared with a case where the wiring load is not same.

Figure 6:
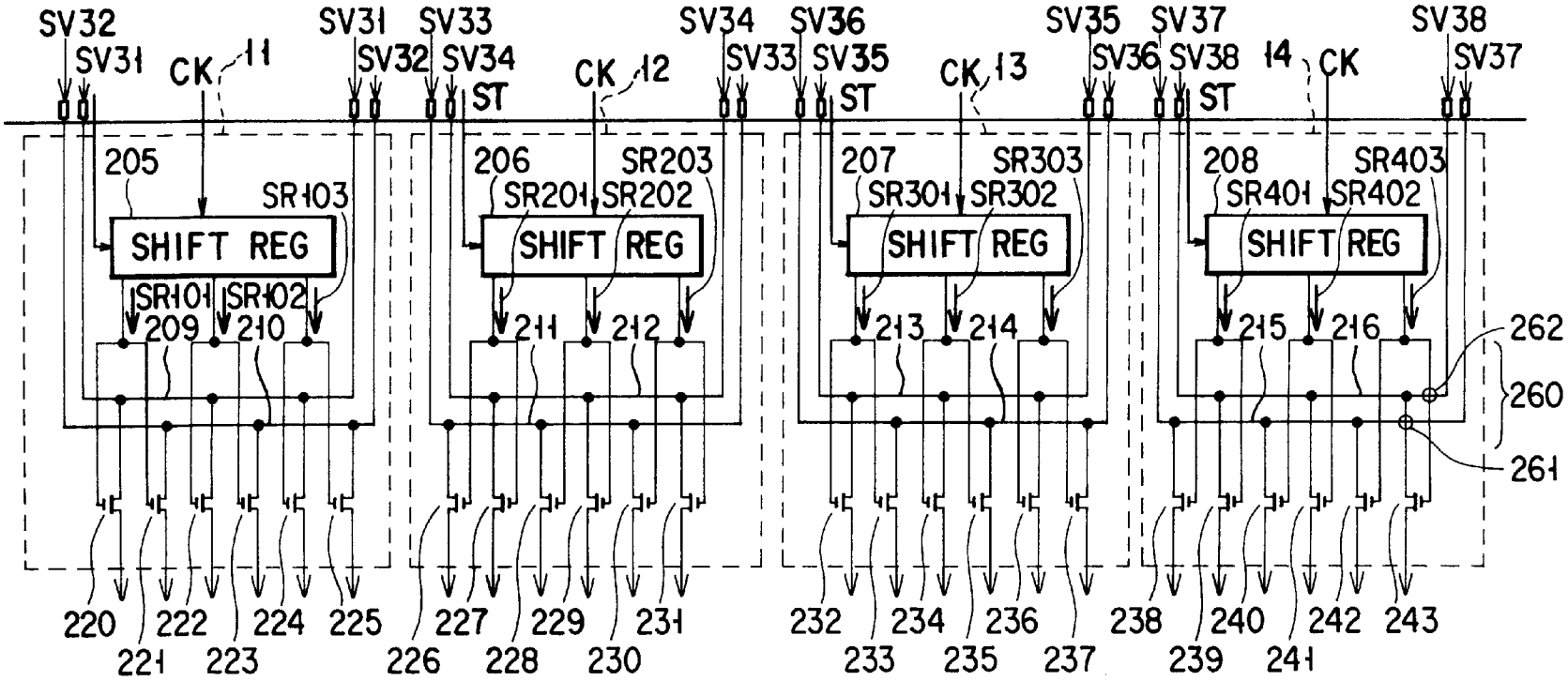
FIG. 6 is a circuit diagram showing in detail a signal line driving circuit of a liquid crystal display device according to a third embodiment of the present invention.

Next, a liquid crystal display device according to a third embodiment of the present invention will be described with reference to FIGS. 6 and 7. This liquid crystal display device is similar to the first embodiment, except for matters described below. FIG. 6 shows the configuration of the signal line driver circuit XD of the liquid crystal display device, and FIG. 6 shows an operation of the signal line driver circuit XD.

The signal line driver blocks 11–14 are constituted as shown in FIG. 6. The signal line driver blocks 11, 12, 13 and 14 respectively include first transmission lines 209, 211, 213 and 215 for transmitting odd-column video signals SV31, SV33, SV35 and SV37, second transmission lines 210, 212, 214 and 216 for transmitting even-column video signals SV2, SV4, SV6 and SV8, groups of analog switches 220–225, 226–231, 232–237 and 238–243 assigned to the six adjacent signal lines 707 and alternately assigned to the first transmission lines 209, 211, 213 and 215 and the second transmission lines 210, 212, 214 and 216, each for sampling the video signal on a corresponding transmission line to supply the sampled video signal to a corresponding signal line 707, and monoclock-type shift registers 205, 206, 207 and 208 each formed to divide the analog switches 220–225, 226–231, 232–237 and 238–243 to a plurality of analog switch groups constituted by two adjacent analog switches whose number is equal to that of the transmission lines and serve as a timing control circuit for sequentially enabling the sample operations of the analog switch groups. These components are formed to have the same structure in the signal line driver blocks, except for the arrangement of the first and second transmission lines. When each of the signal line groups is constituted by six adjacent signal lines in order to avoid complication, the number of the analog switch groups is three. The first and second transmission lines 209 and 210, 211 and 212, 213 and 214, and 215 and 216, constitute video signal buses independently connected to the display panel controller 702. The video signal buses are formed to have video signal input terminals at both end portion sides of shift registers 205, 206, 207 and 208 on the display panel plate 701, and to extend across the connection wirings between the shift registers 205, 206, 207 and 208 and the analog switches 220–225, 226–231, 232–237 and 238–243. The first and second transmission lines of the signal line driver blocks have the same wire length and parasitic capacitance, i.e. wiring load. The first transmission lines 209, 211, 213 and 215 are connected to the odd-numbered signal lines 707 via the odd-numbered analog switches 220, 222, 224; 226, 228, 230; 232, 234, 236; and 238, 240, 242, and the second transmission lines 210, 212, 214 and 216 are connected to the even-numbered signal lines 707 via the even-numbered analog switches 221, 223, 225; 227, 229, 231; 233, 235, 237; and 239, 241, 243. These transmission lines 209–216 are formed in the same process as that for formation of source and drain electrodes of the thin film transistors serving as the switching elements 709. The shift registers 205, 206, 207 and 208 are formed of flip-flops whose number is equal to that of the switch groups arranged in series so as to shift a start pulse ST input to the first flip-flop in the forward direction toward the final flip-flop in response to the clock CK, and thereby sequentially generate enable signals from output terminals SR101, SR102, SR103; SR201, SR202, SR203; SR301, SR302, SR303; and SR401, SR402, SR403. Each flip-flops is a well-known CMOS clocked inverter circuit, and formed by combining thin film transistors obtained in the same process as that of the thin film transistors serving as the switching elements 709. The shift registers 205–208 are in the monoclock type, but may be constituted to respond to the clock CK and the reverse clock. In addition, the shift registers 205–208 may be operated not by the electric power supplied directly from the outside, but by the electric power supplied via a power source line and a ground line (not shown) which are formed as a common bus extends across the signal line driver blocks 11–14.

Figure 7:
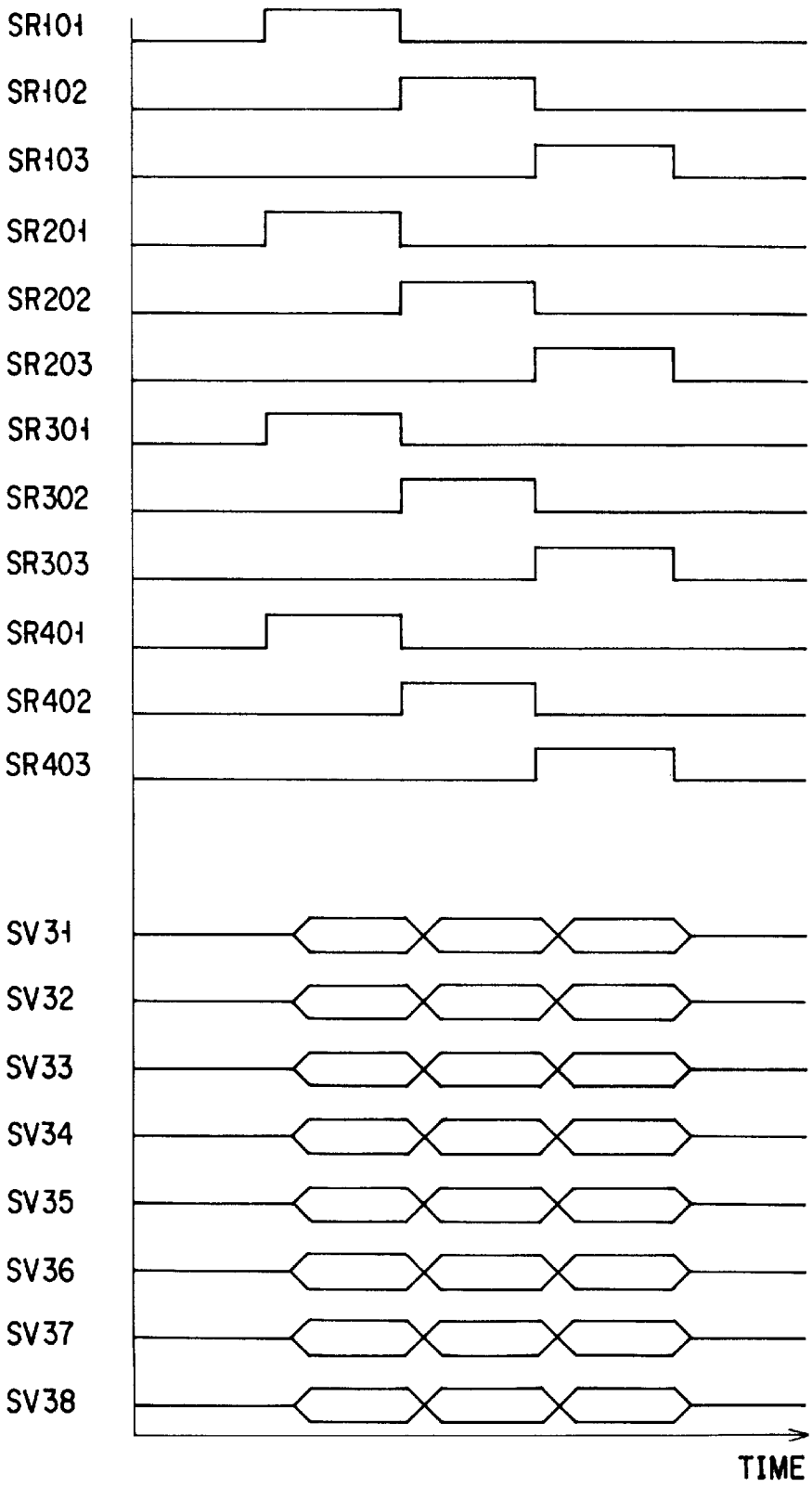
FIG. 7 is a time chart showing an operation of the signal line driving circuit shown in FIG. 6.

FIG. 7 shows an operation of the signal line driver circuit XD. As shown in FIG. 7, the shift registers 205, 206, 207 and 208 perform in parallel the operations of sequentially generating enable signals from the output terminals SR101, SR102, SR103; SR201, SR202, SR203; SR301, SR302, SR303; and SR401, SR402, SR403 in response to the clock CK. That is, the enable signals are output in a first clock cycle from the output terminals SR101, SR201, SR301 and SR401, in a second clock cycle from the output terminals SR102, SR202, SR302 and SR402, and in a third cycle from the output terminals SR103, SR203, SR303 and SR403, and are output in the same manner as the described one if there are the following clock cycles. As a result, the odd-column video signals SV31, SV33, SV35 and SV37 and the even-column video signals SV32, SV34, SV36 and SV38 are sequentially sampled by the analog switch groups receiving the enable signals in the first to third clock cycles and are supplied to the corresponding signal lines 707.

In the above-described third embodiment, the width of a region 260 occupied by the video signal buses shown in FIG. 6 can be reduced. In addition, the number of overlapping portions 261 and 262 where the video signal buses intersect the wirings between the shift registers to the analog switches, can be reduced. As a result, the width of the signal line driver circuit XD can be reduced and the transmission band width of the video signal lines can be improved by reduction of the load capacitance. Further, each of the respective odd-column and even-column video signals is supplied to two video signal input terminals of the corresponding signal line driver block from the display panel controller 702. According to this configuration, the transmission band width of the video signal lines can be further improved.

Figure 8:
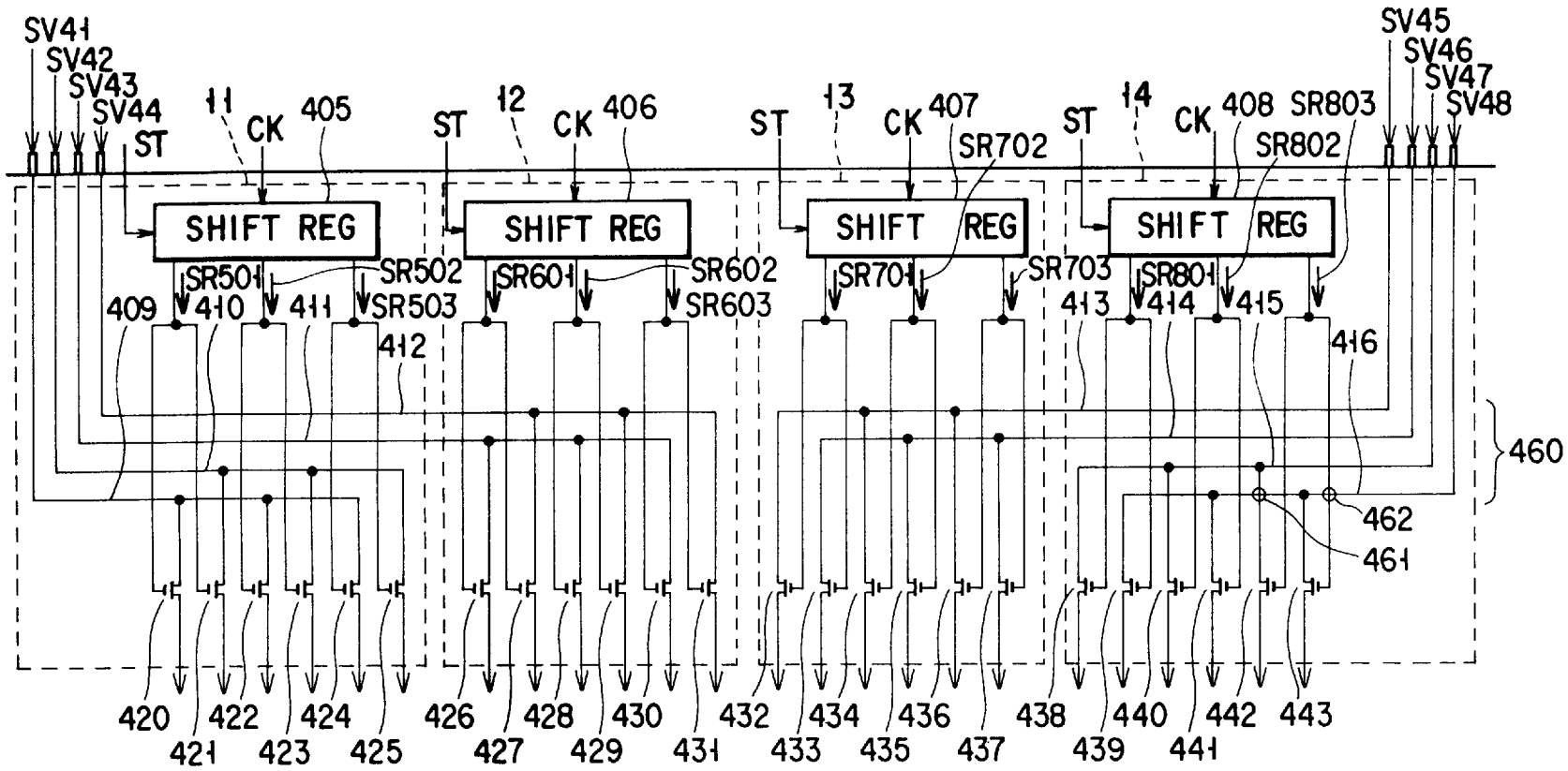
FIG. 8 is a circuit diagram showing in detail a signal line driving circuit of a liquid crystal display device according to a fourth embodiment of the present invention.

Next, a liquid crystal display device according to a fourth embodiment of the present invention will be described with reference to FIGS. 8 and 9. This liquid crystal display device is similar to the first embodiment, except for matters described below. FIG. 8 shows the configuration of the signal line driver circuit XD of the liquid crystal display device, and FIG. 9 shows an operation of the signal line driver circuit XD.

The signal line driver blocks 11–14 are constituted as shown in FIG. 8. The signal line driver blocks 11, 12, 13 and 14 include, respectively, first transmission lines 409, 411, 413 and 415 for transmitting odd-column video signals SV41, SV43, SV45 and SV47, second transmission lines 410, 412, 414 and 416 for transmitting even-column video signals SV42, SV44, SV46 and SV48, groups of analog switches 420–425, 426–431, 432–437 and 438–443 assigned to the six adjacent signal lines 707 and alternately assigned to the first transmission lines 409, 411, 413 and 415 and the second transmission lines 410, 412, 414 and 416, each for sampling video signals on a corresponding transmission line to supply the sampled video signal to a corresponding signal line 707, and monoclock-type shift registers 405, 406, 407 and 408 each formed to divide the analog switches 420–425, 426–431, 432–437 and 438–443 into a plurality of analog switch groups constituted respectively by two adjacent analog switches whose number is equal to that of the transmission lines and serve as a timing control circuit for sequentially enabling the sample operations of the analog switch groups. These components are formed to have the same structure in the signal line driver blocks, except for the arrangement of first and second transmission lines. When each of the signal line groups is constituted by six adjacent signal lines in order to avoid complication, the number of the analog switch groups is three. The first and second transmission lines 409 and 410, 411 and 412, 413 and 414, and 415 and 416, respectively constitute video signal buses independently connected to the display panel controller 702. The transmission lines 409–412 have video signal input terminals at the one-end side of the series unit of the shift registers 405 and 406 on the display panel plate 701. The transmission lines 409 and 410 are formed to extend across the connection wirings between the shift register 405 and the analog switches 420–425, and the transmission lines 411 and 412 are formed to extend across the connection wirings between the shift registers 405 and 406 and the analog switches 420–425 and 426–431. The transmission lines 413–416 have video signal input terminals at the other end side of the series unit of the shift registers 407 and 408 on the display panel plate 701. The transmission lines 413 and 414 are formed to extend across the connection wirings between the shift registers 407 and 408 and the analog switches 432–437 and 438–443, and the transmission lines 415 and 416 are formed to extend across the connection wirings between the shift register 406 and the analog switches 438–443.

The first and second transmission lines of the signal line driver block 11 have the same wiring length and parasitic capacitance, i.e. the wiring load as that of the first and second transmission lines of the signal line driver block 14. Further, the first and second transmission lines of the signal line driver block 12 have the same wiring length and parasitic capacitance, i.e. the wiring load, as that of the first and second transmission lines of the signal line driver block 13. The first transmission lines 409, 411, 413 and 415 are connected to the odd-numbered signal lines 707 via the odd-numbered analog switches 420, 422, 424; 426, 428, 430; 432, 434, 436; and 438, 440, 442. The second transmission lines 410, 412, 414 and 416 are connected to the even-numbered signal lines 707 via the even-numbered analog switches 421, 423, 425; 427, 429, 431; 433, 435, 437; and 439, 441, 443. These transmission lines 409–416 are formed in the same process as that for formation of the source and drain electrodes of the thin film transistors serving as the switching elements 709. The shift registers 405, 406, 407 and 408 are formed of flip-flops whose number is equal to that of the analog switch groups arranged in series so as to shift a start pulse ST input to the first flip-flop in the forward direction toward the final flip-flop in response to a clock CK, and thereby sequentially generate enable signals from output terminals SR501, SR502, SR503; SR601, SR602, 603; SR701, SR702, SR703; and SR801, 802, 803. Each flip-flop is a well-known CMOS clocked inverter circuit, and formed by combining thin film transistors obtained in the same process as that of the thin film transistors serving as the switching elements 709. The shift registers 405–408 are in the monoclock type, but may be constituted to respond to the clock CK and the reverse clock. In addition, these shift registers 405–408 may be operated not by the electric power supplied directly from the outside, but by the electric power supplied via a power source line and a ground line (not shown) which are formed as a common bus extends across the signal line driver blocks 11–14.

Figure 9:
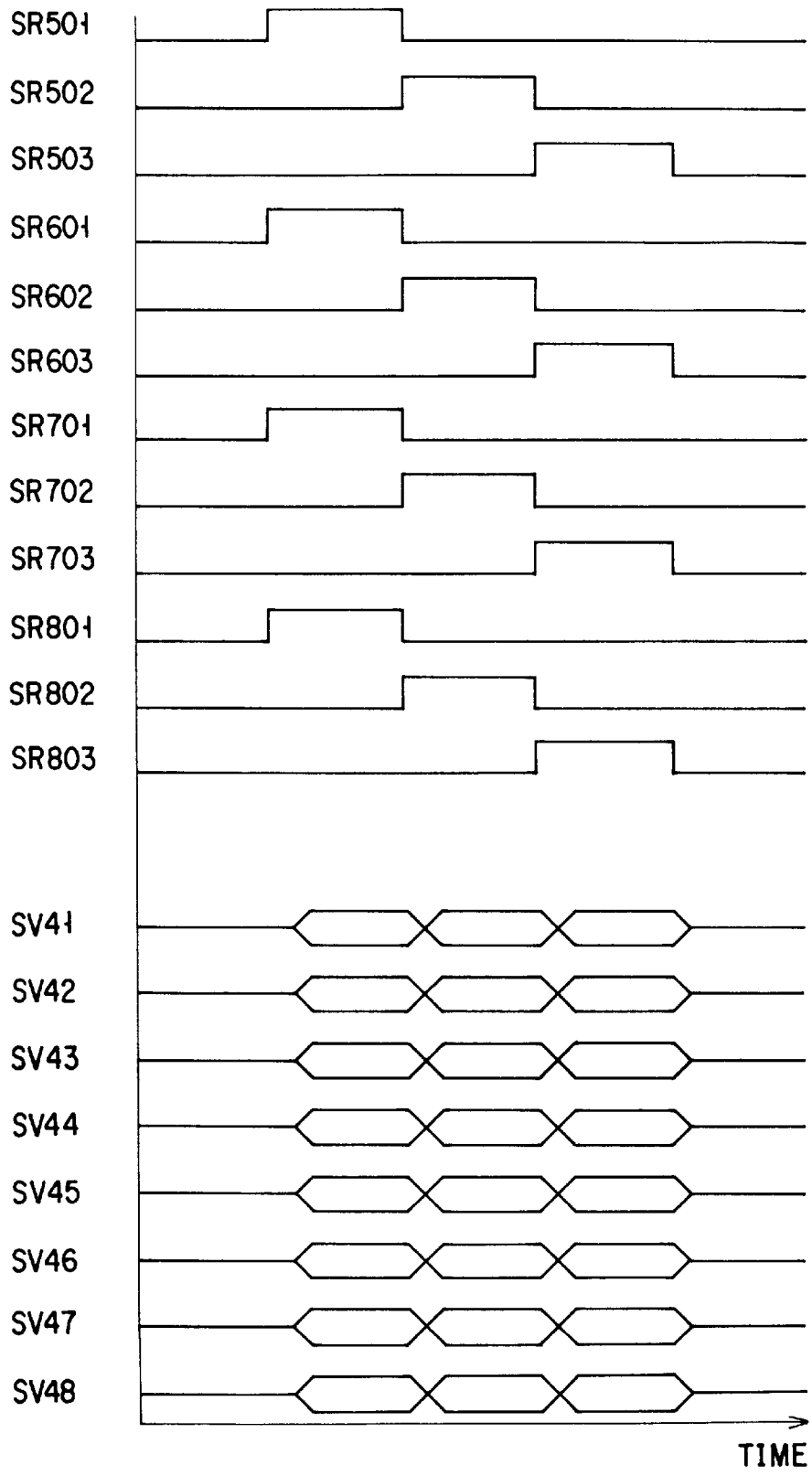
FIG. 9 is a time chart showing an operation of the signal line driving circuit shown in FIG. 8.

FIG. 9 shows an operation of the signal line driver circuit XD. As shown in FIG. 9, the shift registers 405, 406, 407 and 408 perform in parallel the operations of sequentially generating the enable signals from the output terminals SR501, SR502, SR503; SR601, SR602, SR603; SR701, SR702, SR703; and SR801, SR802, SR803, in response to the clock CK. That is, the enable signals are output in a first clock cycle from the output terminals SR501, SR601, SR701 and SR803, in a second cycle from the output terminals SR502, SR602, SR702 and SR802, and in a third cycle from the output terminals SR503, SR603, SR703 and SR803, and are output in the same manner if there are the following clock cycles. As a result, the odd-column video signals SV41, SV43, SV45 and SV47 and the even-column video signals SV42, SV44, SV46 and SV48 are sequentially sampled by the analog switch groups receiving the enable signals in the first to third cycles and are supplied to the corresponding signal lines 707.

In the fourth embodiment, the width of a region 460 occupied by the video signal buses shown in FIG. 8 can be reduced. In addition, the number of overlapping portions 461 and 462 where the video signal buses intersect the wirings between the shift registers and the analog switches, can be reduced. As a result, the width of the signal line driver circuit XD can be made smaller and the transmission band width of the video signal lines can be improved by reduction of the load capacitance.

In each of the above-described embodiments, the signal line driver circuit XD is constituted by four signal line driver blocks, but the present invention is not limited to this.

Further, in each of the above-described embodiments, the number of the video signal transmission lines in every signal line driver block of the video signals may be reduced to one. In this case, the enable signal is supplied to the even-numbered analog switches at the timing different from that of the odd-numbered analog switches by, for example, doubling the number of the flip-flops of the shift registers.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A flat-panel display device, comprising:

a display panel plate;

a plurality of display pixels arrayed in a matrix on said display panel plate;

a plurality of signal lines formed on said display panel plate along columns of said display pixels;

a scanning section formed on said display panel plate, for sequentially and periodically selecting rows of the display pixels to connect the display pixels of a selected row to said signal lines; and a driver section formed on said display panel plate, for driving the display pixels of the selected row via said signal lines;

wherein said driver section includes a plurality of signal line driver blocks which are arranged to partition said signal lines into signal line groups, each having a predetermined number of adjacent signal lines, receives individual video signals supplied for said signal line groups from an outside of said display panel plate, and performs operations of driving the signal line groups on the basis of the individual video signals, in parallel;

each of said signal line driver blocks includes a sampling section for sampling a corresponding video signal to be supplied to said predetermined number of signal lines, and a timing control circuit for controlling an operation timing of said sampling section according to a common control signal supplied from outside of said display panel plate; and said sampling section includes a plurality of transmission lines for transmitting a plurality of component video signals derived from the video signal, and a plurality of analog switches connected via connection wirings to said timing control circuit, respectively assigned to said predetermined number of adjacent signal lines and sequentially assigned to said plurality of transmission lines, each for sampling the component video signal on a corresponding transmission line to be supplied to a corresponding signal line;

said plurality of transmission lines of each sampling section extend across the connection wirings in a corresponding signal line driver block and are separated from those included in the other signal line driver blocks, on said display panel plate.

2. A flat-panel display device according to claim 1, wherein said timing control section divides said plurality of analog switches into a plurality of analog switch groups each having adjacent analog switches whose number is equal to that of said transmission lines, and to sequentially enable the sample operations of said plurality of analog switch groups.

3. A flat-panel display device according to claim 2, wherein said timing control section includes shift registers arranged along said plurality of analog switch groups and having a plurality of output terminals connected commonly to the analog switches of a corresponding analog switch group, for sequentially outputting enable signals from the output terminals.

4. A flat-panel display device according to claim 3, wherein, each of the transmission lines in the signal line driver blocks is formed to have a video signal input terminal located on at least one end side of said shift register and extend in a common length and across wirings connected between said shift register and said plurality of analog switches.

5. A flat-panel display device according to claim 4, wherein shifting directions of said shift registers in the adjacent signal line driver blocks are set to be coincide with each other when the video signal input terminals are set on the same end sides of said shift registers.

6. A flat-panel display device according to claim 4, wherein shifting directions of said shift registers in the adjacent signal line driver blocks are set to be reversed from each other when the video signal input terminals are set at the one-end side and the other end side of said shift registers.

* * * * *